US006955721B2

(12) United States Patent
Baker et al.

(10) Patent No.: US 6,955,721 B2
(45) Date of Patent: Oct. 18, 2005

(54) SYSTEM AND METHOD OF COATING PRINT MEDIA IN AN INKJET PRINTER

(75) Inventors: Ronald Willard Baker, Versailles, KY (US); Michael Wesley Baskette, Lexington, KY (US); Randall Steven Gall, Lexington, KY (US); Hishikesh Pramod Gogate, Lexington, KY (US); James Philip Harden, Lexington, KY (US); Philip Jerome Heink, Lexington, KY (US); Andrew Charles Hogan, Lexington, KY (US); Royden Thomas Kern, Lexington, KY (US); Jean Marie Massie, Lexington, KY (US); Sean David Smith, Lexington, KY (US); Mark Alan Wahl, Santa Claus, IN (US)

(73) Assignee: Lexmark International, Inc., Lexington, KY (US)

( * ) Notice: Subject to any disclaimer, the term of this patent is extended or adjusted under 35 U.S.C. 154(b) by 126 days.

(21) Appl. No.: 10/086,985

(22) Filed: Feb. 28, 2002

(65) Prior Publication Data

US 2003/0165630 A1 Sep. 4, 2003

(51) Int. Cl.[7] ..... B05C 1/00

(52) U.S. Cl. ..... 118/244; 118/249; 118/262; 118/46; 427/428; 347/101

(58) Field of Search ..... 347/101; 346/135.1; 118/244, 249, 262, 46; 427/428

(56) References Cited

U.S. PATENT DOCUMENTS

| | | | | |
|---|---|---|---|---|
| 3,301,156 A | | 1/1967 | Roeber | |
| 3,499,419 A | | 3/1970 | Bohmer et al. | |
| 3,647,525 A | | 3/1972 | Dahlgren | |
| 3,776,133 A | | 12/1973 | Ritzerfeld | |
| 3,885,066 A | | 5/1975 | Schwenninger | |
| 3,990,132 A | * | 11/1976 | Illman et al. | 28/178 |
| 4,139,660 A | * | 2/1979 | Tur | 427/353 |
| 4,141,317 A | | 2/1979 | Lakhani | |
| 4,161,141 A | | 7/1979 | Lakhani | |
| 4,165,686 A | | 8/1979 | Borelli et al. | |
| 4,270,859 A | | 6/1981 | Galbraith et al. | |

(Continued)

FOREIGN PATENT DOCUMENTS

| | | | | |
|---|---|---|---|---|
| EP | 0 726 156 A1 | | 8/1996 | |
| EP | 0 778 321 A2 | | 6/1997 | |
| EP | 0 822 094 A2 | | 2/1998 | |
| JP | SHO 63 299971 A | | 12/1988 | |
| WO | WO 99/64243 | | 12/1999 | |
| WO | WO9964243 | * | 12/1999 | B41J/2/01 |

OTHER PUBLICATIONS

U.S. Appl. No. 10/083,722, filed Feb. 26, 2002, Heink et al.

U.S. Appl. No. 10/084,256, filed Feb. 27, 2002, Hogan et al.

*Primary Examiner*—Chris Fiorilla
*Assistant Examiner*—Michelle AceVedo Lazor
(74) *Attorney, Agent, or Firm*—Bernard L. Zidar, Esq.

(57) ABSTRACT

A coating apparatus for applying a coating liquid to a printing substrate. The coating apparatus has a rotatable first roll and a rotatable second roll, each having a surface energy. The second roll is positioned adjacent to the first roll and defines with the first roll a first nip through which the printing substrate passes A metering device is provided for applying a substantially uniform layer of coating liquid onto the second roll. The second roll in turn transfers the coating liquid to the printing substrate. The surface energy of the second roll is greater than the surface energy of the coating liquid. In one embodiment, the metering device includes a rotatable third roll and a doctor blade contacting the third roll, each having a surface energy. The surface energy of at least a portion of either or both the third roll and doctor blade is less than the surface energy of the coating liquid.

20 Claims, 6 Drawing Sheets

U.S. PATENT DOCUMENTS 4,354,851 A 10/1982 Hix et al.
4,373,798 A 2/1983 Tsukada et al.
4,382,262 A 5/1983 Savit
4,449,476 A 5/1984 Voswinckel et al. ..... 118/674
4,478,505 A 10/1984 Tashiro
4,503,802 A 3/1985 Keller et al.
4,521,785 A 6/1985 Matsufuji
4,527,171 A 7/1985 Takanashi et al.
4,538,906 A 9/1985 Brown
4,599,627 A 7/1986 Vollert
4,643,130 A 2/1987 Sheath et al.
4,685,414 A 8/1987 DiRico
4,702,742 A 10/1987 Iwata et al.
4,704,615 A 11/1987 Tanaka
4,721,968 A 1/1988 Aral et al.
4,738,879 A 4/1988 Williams
4,766,840 A 8/1988 Beckley et al.
4,786,288 A 11/1988 Handa et al.
4,797,707 A 1/1989 Iwahashi et al.
4,838,985 A 6/1989 Karagiannis
4,839,200 A 6/1989 Hoffman et al.
4,909,182 A * 3/1990 Hanson et al. ..... 118/692
4,949,131 A 8/1990 Ito
4,949,667 A 8/1990 Yoshida et al.
5,006,862 A 4/1991 Adamic
5,034,777 A 7/1991 Ohezeki et al.
5,045,888 A 9/1991 Imaeda
5,075,153 A 12/1991 Malhotra
5,085,171 A 2/1992 Aulick et al.
5,107,788 A 4/1992 Boldrini et al.
5,116,148 A 5/1992 Ohara et al.
5,117,768 A 6/1992 Seymour
5,132,706 A 7/1992 Yuasa et al.
5,141,599 A 8/1992 Jahn et al.
5,178,678 A 1/1993 Koehler et al.
5,207,159 A 5/1993 DeMoore et al.
5,220,346 A 6/1993 Carreira et al.
5,230,926 A 7/1993 Narang et al.
5,255,023 A 10/1993 Bowlby, Jr. et al.
5,305,020 A 4/1994 Gibbons et al.
5,315,322 A 5/1994 Bannai
5,323,176 A * 6/1994 Sugiura et al. ..... 346/25
5,337,032 A 8/1994 Baker et al.
5,372,852 A 12/1994 Titterington et al.
5,475,473 A * 12/1995 Masuda et al. ..... 399/168
5,505,776 A 4/1996 Pichler et al. ..... 118/203
5,633,045 A 5/1997 Smith et al. ..... 427/428
5,671,675 A * 9/1997 Okuda et al. ..... 101/424.2
5,677,008 A 10/1997 Kameya et al. ..... 427/428
6,006,059 A * 12/1999 Till et al. ..... 399/249
6,444,270 B1 9/2002 Naruse ..... 427/359
6,451,438 B1 * 9/2002 Chiang et al. ..... 428/447

* cited by examiner

SYSTEM AND METHOD OF COATING PRINT MEDIA IN AN INKJET PRINTER

BACKGROUND OF THE INVENTION

1. Field of the Invention

The present invention generally relates to a method and apparatus for coating print media in an inkjet printer system. More particularly, the present invention relates to a method and apparatus wherein the surface energy of rollers and/or doctor blades within the coating apparatus are controlled relative to the surface energy of the coating liquid.

2. Background Art

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle A plurality of chambers, each provided with a single heating element, are provided in the printer's print head. The print head typically comprises the heater chip and a nozzle plate having a plurality of the discharge nozzles formed therein. The print head forms part of an ink jet print cartridge that also comprises an ink-filled container.

Ink jet printers have typically suffered from two major shortcomings. First, optical density of a printed image varies greatly with the print media or substrate being printed upon. Second, ink drying time is excessive on some media types.

Interaction between the ink and print media or substrate influences the performance of the ink jet printer Different media types behave differently with the ink and not all media types are well suited for ink jet printing. Accordingly, attempts have been made to apply a liquid coating to the media before printing that interacts with the ink to improve the quality of the resulting printed image. The ink may contain, for example, penetrants to improve dry time and binders to improve performance. The "precoating" liquids may contain materials that cause the ink to flocculate on the surface of the media, improving image quality Precoating liquids have previously been applied to the print media using a separate ink jet print head and by the use of a roll coating apparatus that directly contacts the print media prior to ink application. One roll coating apparatus and method of the prior art is shown and described in U.S. Pat. No. 6,183,079, assigned to Lexmark International, Inc.

Precoating systems of the prior art, however, suffer from several shortcomings. For example, ink jet precoating systems require that the precoating liquid have a sufficiently low viscosity to pass consistently through the print head. Such liquids typically have an undesirably long dry time and cause undesirable cockle and curl in the medium. Prior art roll precoating systems have not provided optimum control over the amount of precoating liquid applied to the print medium Because the roll coater typically remains in contact with the medium during stop-start printing, coat weight irregularity, often referred to as "banding," has occurred in prior art roll coating systems. Severe banding may be aesthetically unacceptable and may disturb the interaction between the coating liquid and the ink Banding frequently occurs when the rolls are stopped and the printer is depositing ink onto the substrate. During that time, coating remaining on the rolls may be absorbed by the substrate, resulting in a high coat weight at that location and a visible band.

Coat weight irregularity may also result from capillary wicking under and around the doctor blade that meters coating liquid onto a roller in the roll coating system. When the roll coating system is idle, excess coating liquid may be drawn under or around the doctor blade and accumulate downstream of the doctor blade When the coating system is restarted, that accumulated coating liquid is transferred through the system, frequently resulting in coat weight irregularity.

Accordingly, there is a need for an improved ink jet printer and a coating apparatus for such a printer that is capable of printing images uniformly on a wide variety of commercially available substrates, wherein ink drying time is minimized and printed image quality is maximized.

SUMMARY OF THE INVENTION

The present invention, in one aspect, is a coating apparatus for applying a coating liquid to a printing substrate The apparatus includes a rotatable first roll positioned adjacent to a rotatable second roll, defining a first nip therebetween through which the printing substrate passes A metering device is provided for applying a substantially uniform layer of coating liquid onto the second roll, which in turn transfers the coating liquid to the printing substrate The coating liquid and the material that makes up the second roll are selected such that the surface energy of the second roll is greater than the surface energy of the coating liquid.

In another aspect, the invention includes a third roll adjacent the second roll, the second and third rolls defining a second nip therebetween A doctor blade contacts the third roll and meters a substantially constant amount of coating liquid onto the third roll The coating liquid is transferred from the third roll to the second roll at the second nip, the second roll in turn transferring the coating liquid to the printing substrate. In one embodiment, the coating liquid and the material that makes up the second roll are selected such that the surface energy of the second roll is greater than the surface energy of the coating liquid In another embodiment, the material that makes up the second roll and the material that makes up the third roll are selected such that the hardness of the second roll is less than the hardness of the third roll.

In another aspect, the surface energy of at least a portion of the distal edge is less than the surface energy of the coating liquid. In yet another aspect, the surface energy of at least a portion of the third roll is less than the surface energy of the coating liquid.

DETAILED DESCRIPTION OF THE INVENTION

Figure 1:
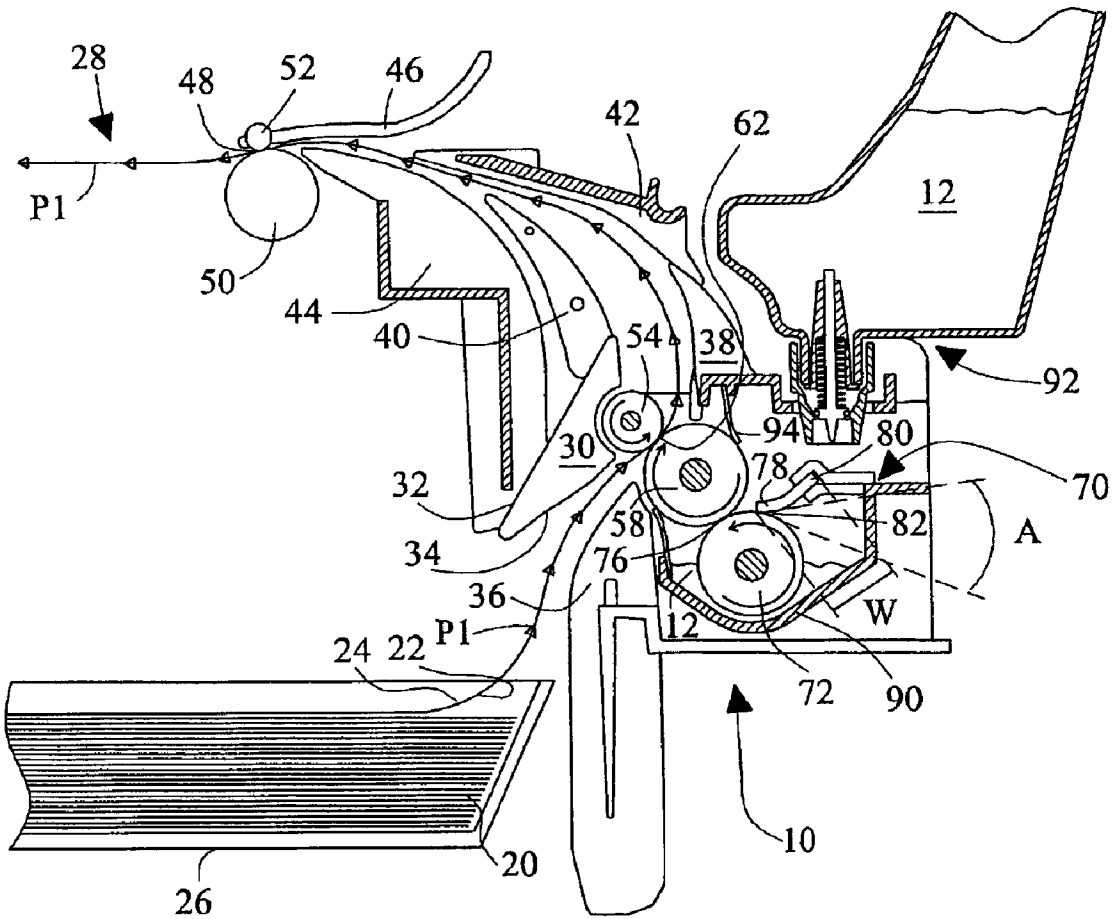
FIG. 1 is a side elevational view of a coating apparatus according to one embodiment of the present invention.

Several embodiments of the invention are now described in detail The disclosed embodiments are intended as illustrative only since numerous modifications and variations therein will be apparent to those skilled in the art. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The present invention, in one embodiment, is an ink jet printer including a coating apparatus 10 for applying a coating liquid 12 to a printing substrate 20 The substrate 20 has a front surface 22 that receives the coating liquid 12 and the printing ink, and an opposite rear surface 24 The ink jet printer comprises a printing apparatus (not shown) located in a print zone 28 within a printer housing (not shown). The printer apparatus includes an ink jet print cartridge (not shown) supported in a carrier (not shown) which, in turn, is supported on a guide rail (not shown) A drive mechanism (not shown) including a drive belt is provided for effecting reciprocating movement of the carrier and the print cartridge back and forth along the guide rail As the print cartridge moves back and forth, it ejects ink droplets onto a printing substrate 20 provided below it Substrates capable of being printed upon by the printer include commercially available plain office paper, specialty papers, envelopes, transparencies, labels, card stock and the like. A more detailed disclosure of the printing apparatus, printer housing, cartridge, carrier, guide rail and drive mechanism is set out in U.S. Pat. No. 6,183,079, assigned to Lexmark International, Inc., and in the patents and patent applications cited and incorporated by reference therein Those disclosures are expressly incorporated herein by reference.

Figure 2:
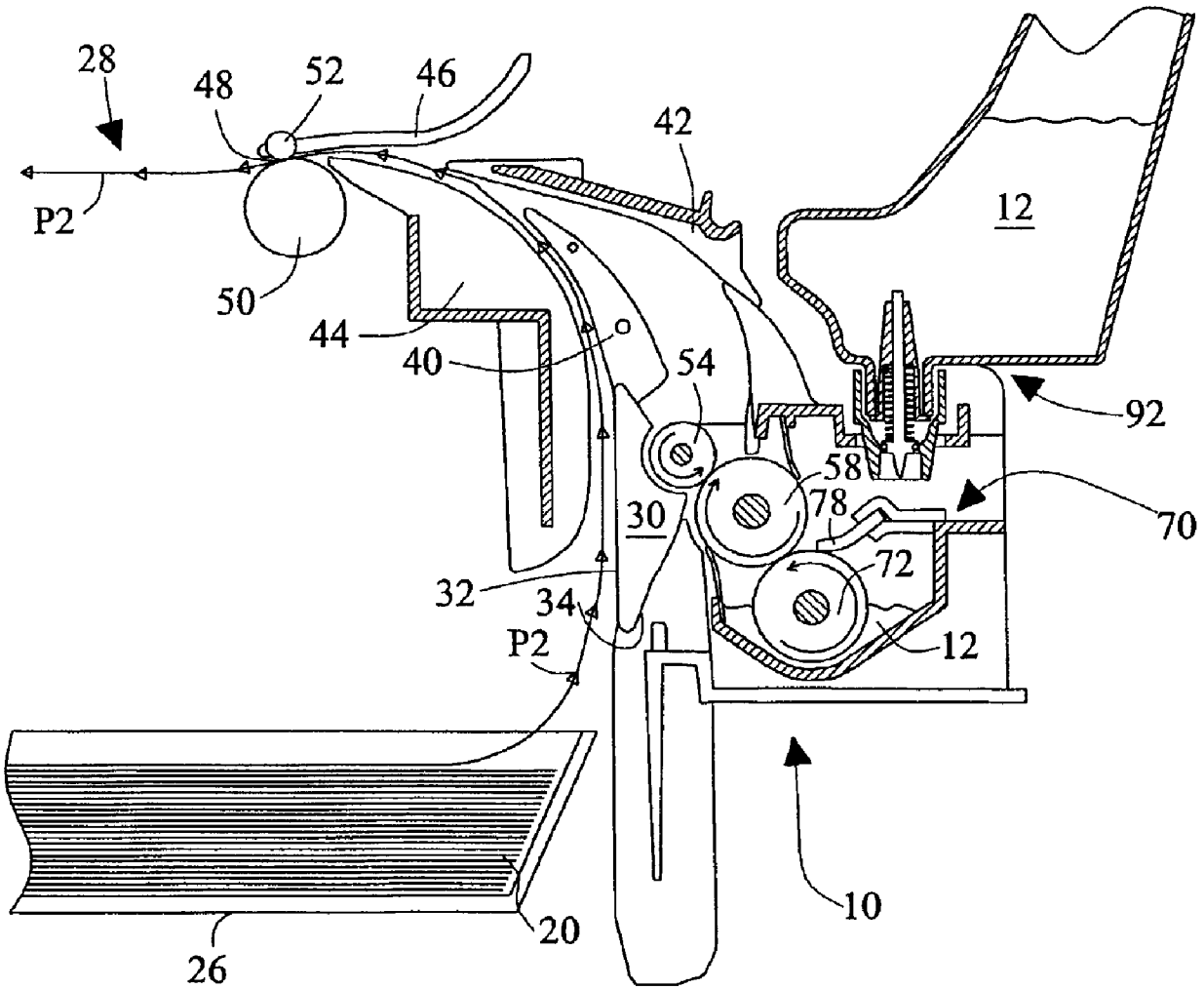
FIG. 2 is a side elevational view of a coating apparatus according to a second embodiment of the present invention.

Referring now to FIGS. 1 and 2, the coating apparatus 10 is located between the substrate tray 26 and the printing apparatus. The coating apparatus 10 includes a bypass mechanism that may be configured such that a user may interchangeably select whether the printing substrate 20 passes through the coating apparatus 10 or proceeds directly from the substrate tray 26 to the printing apparatus. As illustrated in FIG. 1, if the user elects to utilize the coating apparatus 10, the substrate 20 follows a first feed path P1 wherein the substrate 20 passes through the coating apparatus 10 after leaving the tray 26 and before entering the print zone 28 As shown in FIG. 2, the coating apparatus 10 may be bypassed in the other configuration wherein the substrate 20 follows a second feed path P2.

FIG. 1 illustrates a configuration in which the substrate 20 is passed through the coating apparatus 10 The printing substrate 20 is picked from a substrate tray 26 and passed through the coating apparatus 10 to a print zone 28 where ink from the print cartridge is deposited on the front surface 22 of the substrate 20. As the printing substrate 20 leaves the tray, it passes between a diverter 30 and a lower paper guide 36 The diverter 30 has a front surface 34 and an opposite rear surface 32, and is mounted on a pivot (not shown) so that the diverter 30 may be rotated to either of two positions for receiving printing substrates 20. When the diverter 30 is in the coating position, the printing substrate 20 contacts the front surface 34 of the diverter 30 and is directed into the coating apparatus 10.

The coating apparatus 10 includes a rotatable first roll 54 positioned adjacent to a rotatable second roll 58 defining a first nip 62 therebetween through which the printing substrate 20 passes, and a metering device 70. The substrate 20 enters the first nip 62, where coating liquid 12 is applied to the front surface 22 of the substrate 20. In the illustrated embodiment, the substrate 20 is fed to the first nip 62 such that the front surface 22 of the substrate 20 contacts the second roll 58 and receives coating liquid 12 thereon.

After the substrate 20 passes through the first nip 62, the substrate 20 is guided by deflector ribs 38, between the intermediate paper guide 40 and the outer paper guide 42, past the inner paper guide 44 and backup roll trucks 46, and finally passes through an exit nip 48 between the feed roll 50 and the backup roll 52. The feed roll 50, which is rotationally driven by a printer drive motor (not shown), then controls the motion of the substrate 20 and moves the substrate 20 into the print zone 28 for ink jet printing.

FIG. 2 illustrates an alternate configuration in which the substrate 20 bypasses the coating apparatus 10 and moves directly to the print zone 28. This configuration is selected if the print quality of the selected substrate 20 would not be enhanced, or might be reduced, by passing the substrate 20 through the coating apparatus 10. Printing substrates 20 such as transparencies, coated paper and photo paper may fall into this category. In this configuration, the diverter 30 is rotated about its pivot to divert the substrate 20 past the coating apparatus 10. The substrate 20 passes between the rear surface 32 of the diverter 30 and the inner paper guide 44, then passing the intermediate paper guide 40, the outer paper guide 42, and the backup roll trucks 46 to the exit nip 48.

The rolls and metering device 70 of the coating apparatus 10 are now described in detail Several embodiments of the metering device 70 of the present invention are currently contemplated. In a first embodiment, illustrated in FIG. 1, the metering device 70 includes an additional rotatable third roll 72 contacting the second roll 58 and forming a second nip 76 therebetween. The third roll 72 contacts a supply of coating liquid 12, which adheres at least partially to the outer surface of the third roll 72. As the third roll 72 rotates, a doctor blade 78 in contact with the outer surface of the third roll 72 meters the coating liquid 12 such that a controlled and substantially constant amount of coating liquid 12 passes the blade At the second nip 76, a substantially constant layer of coating liquid 12 is then transferred by contact from the third roll 72 to the second roll 58

The rolls are mounted within the housing such that roll-to-roll contact is maintained at the nips between the respective rolls. In one embodiment, the third roll 72 is mounted in fixed bearings (not shown) at each longitudinal end The second roll 58 is mounted on pivoting bearing swing arms on each longitudinal end, and each arm is spring loaded to maintain contact between the second roll 58 and the third roll 72. The first roll 54 is mounted in plastic bearings on each longitudinal end that ride in slots (also not shown) in a top portion of the housing. The bearings are also spring loaded to load the first roll 54 in contact with the second roll 58. Alternatively, numerous other mounting methods may be employed to fix the relative positions of the respective rolls, as long control over contact and relative position between the rolls is maintained.

Figure 3:
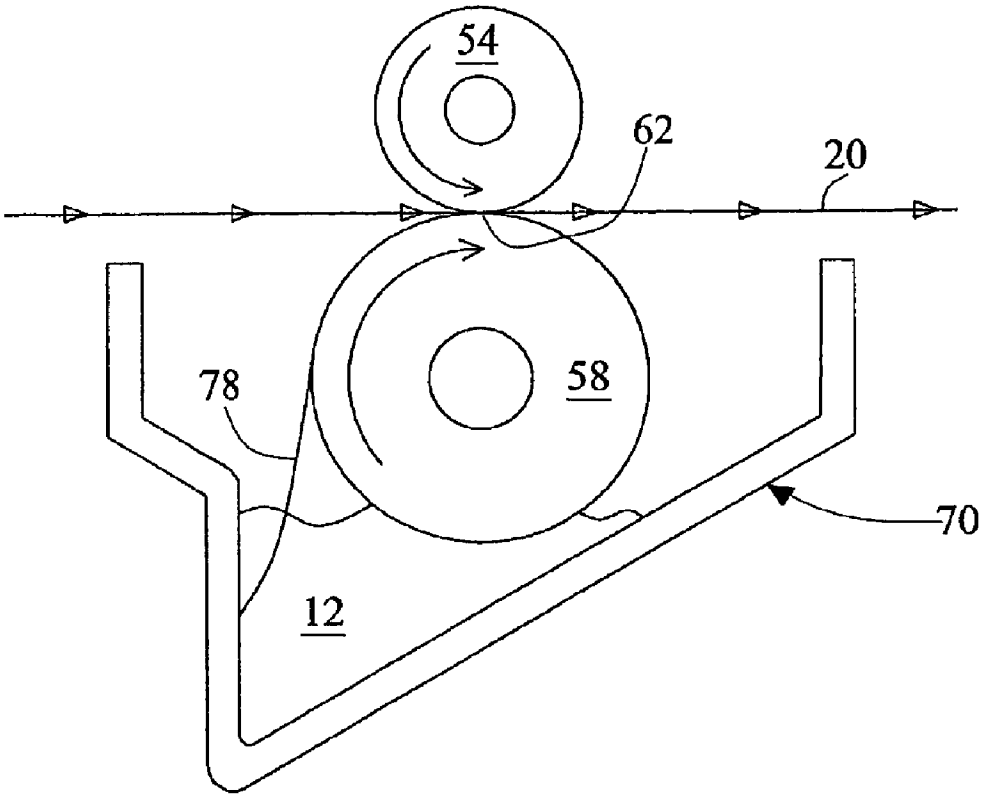
FIG. 3 is a side elevational view of a coating apparatus according to a third embodiment of the present invention.

In another embodiment of the metering device 70, illustrated in FIG. 3, no third roll 72 is required Instead, the second roll 58 contacts a supply of coating liquid 12, and a doctor blade 78 contacting the outer surface of the second roll 58 meters the liquid such that a substantially constant layer of coating liquid 12 passes the blade These embodiments are discussed in greater detail below As will be clear from the description and references to the drawing figures, the embodiments share several common features.

In any embodiment, power may be input via an off-line gear train and coater drive motor (not shown) to a gear (not shown) on a selected one of the rolls, such as the third roll 72 In one embodiment, all of the rolls are geared together, therefore the coater drive motor drives rotation of all rolls. In other embodiments, fewer than all of the rolls may be geared together. In such embodiments, the remaining roll(s) may be driven rotationally by contact with a neighboring roll at the nip therebetween. The system may be driven incrementally or continuously Referring to FIGS. 1–3, in all embodiments of the invention, the first roll 54 may be formed from aluminum with a grit blasted outer surface. The outer surface of the first roll 54 may be grit blasted to a surface roughness of between about 1 and about 4 micrometers $R_a$ After grit blasting, the first roll 54 may be anodized to harden the outer surface to make it less prone to wear.

Alternatively, the first roll 54 may be formed from metals other than aluminum, polymeric materials, ceramic materials, or other suitable materials. Because in the illustrated embodiments the first roll 54 is not intended to transfer coating liquid 12 to the substrate 20, neither the surface condition nor the material from which the first roll 54 is fabricated is considered to be critical to practice the invention.

In the embodiment of the invention illustrated in FIGS. 1 and 2, the metering device 70 includes a third roll 72, a coating material supply device 92 for maintaining a supply of coating liquid 12, and a doctor blade 78. The doctor blade 78 has a proximal edge 80 and an opposite distal edge 82 that contacts the outer surface of the third roll 72 In the illustrated embodiment, the doctor blade 78 is mounted such that the distal edge 82 is biased against the third roll 72 and contacts the third roll 72 along a contact line with a contact force. In other not shown embodiments, the doctor blade may be positioned such that the distal edge contacts, but is not biased against, the third roll and therefore imparts little or no contact force to the third roll. Alternatively, the distal edge of the doctor blade may be near, but not in contact with, the third roll. Additional disclosure of suitable coating material supply devices are set forth in U.S. Pat. No. 6,183,079 and the references cited therein, which have already been incorporated in their entirety into this disclosure.

In the illustrated embodiment, the doctor blade 78 is fixedly positioned such that the doctor blade 78 is deflected along its width W when the distal edge 82 contacts the third roll 72 The spring force of the deflected doctor blade 78 provides the contact force between the third roll 72 and the blade At the distal edge 82, the doctor blade 78 forms a contact angle A between the doctor blade 78 and a plane tangent to the third roll 72 along the contact line.

In other not shown embodiments, the proximal edge of the doctor blade may be pivotally mounted on a shaft which, in turn, is mounted to the housing. A torsion spring may be provided to bias the distal edge of the doctor blade toward the third roll and maintain the contact force between the doctor blade and the third roll. Additionally, other not shown configurations are contemplated according to the invention and will be apparent to one of ordinary skill in the art. For example, a pivotally mounted doctor blade may be biased by other springs, such as linear coil springs or leaf springs. Other configurations, including variations and combinations of the configurations set forth herein, will be apparent to one skilled in the art.

In the illustrated embodiment, the third roll 72 is at least partially contained within a coating material receiving trough 90 within the housing. The trough 90 is at least partially filled with coating liquid 12, such that at least a portion of the third roll 72 resides in a bath of coating liquid 12. As coating liquid 12 is removed from the trough 90 by operation of the coating apparatus 10 during printing, the trough 90 is replenished with additional coating liquid 12 by the coating material supply device 92.

As the third roll 72 rotates within the trough 90, coating liquid 12 adheres to the outer surface of the third roll 72 and is removed from the trough 90. The doctor blade 78 is positioned between the trough 90 and the second nip 76 such that coating liquid 12 is metered by the doctor blade 78 before it reaches the second nip 76. Excess coating liquid 12 that does not pass the doctor blade 78 may be discarded, or may be returned to the trough 90 for reuse as shown in the illustrated embodiment Two main factors affect the quantity of coating liquid 12 that passes the doctor blade 78 First, as the rolls rotate, the coating liquid 12 adhering to the outer surface of the third roll 72 exerts a hydrodynamic pressure on the doctor blade 78, tending to push the distal edge 82 of the blade away from the outer surface of the third roll 72. As the distal edge 82 separates from the third roll 72, an increased volume of coating liquid 12 passes the doctor blade 78. The hydrodynamic pressure is opposed by the contact force with which the doctor blade 78 contacts the third roll 72. Factors affecting the hydrodynamic pressure include blade contact angle A, viscosity of the coating liquid 12 and roller speed. Second, any surface roughness or voids resident in the outer surface of the third roll 72 will affect the quantity of coating liquid 12 that passes the doctor blade 78. Coating liquid 12 contained within voids or indentations in the outer surface of the third roll 72 will pass beneath the doctor blade 78.

Among other things, one design objective of the present device and method is to make the coating apparatus 10 insensitive to coating speed (i.e., the speed at which the printing substrate 20 passes through the coating apparatus 10) by attempting to eliminate the impact of hydrodynamic pressure on the coating apparatus 10. When the effect of hydrodynamic pressure on the coating apparatus 10 is minimized, the amount of coating liquid 12 introduced to the printing substrate 20 may be more precisely controlled because the quantity of coating liquid 12 passing the doctor blade 78 becomes essentially a factor of the surface condition of the third roll 72. That is, the quantity of coating liquid 12 passing the blade may be directly regulated by controlling the surface condition of the third roll 72. Rolls having a larger total volume of surface voids or indentations (i.e., a relatively rough roll) will transfer a greater volume of coating liquid 12 past the doctor blade 78 than a smoother roll.

Figure 4:
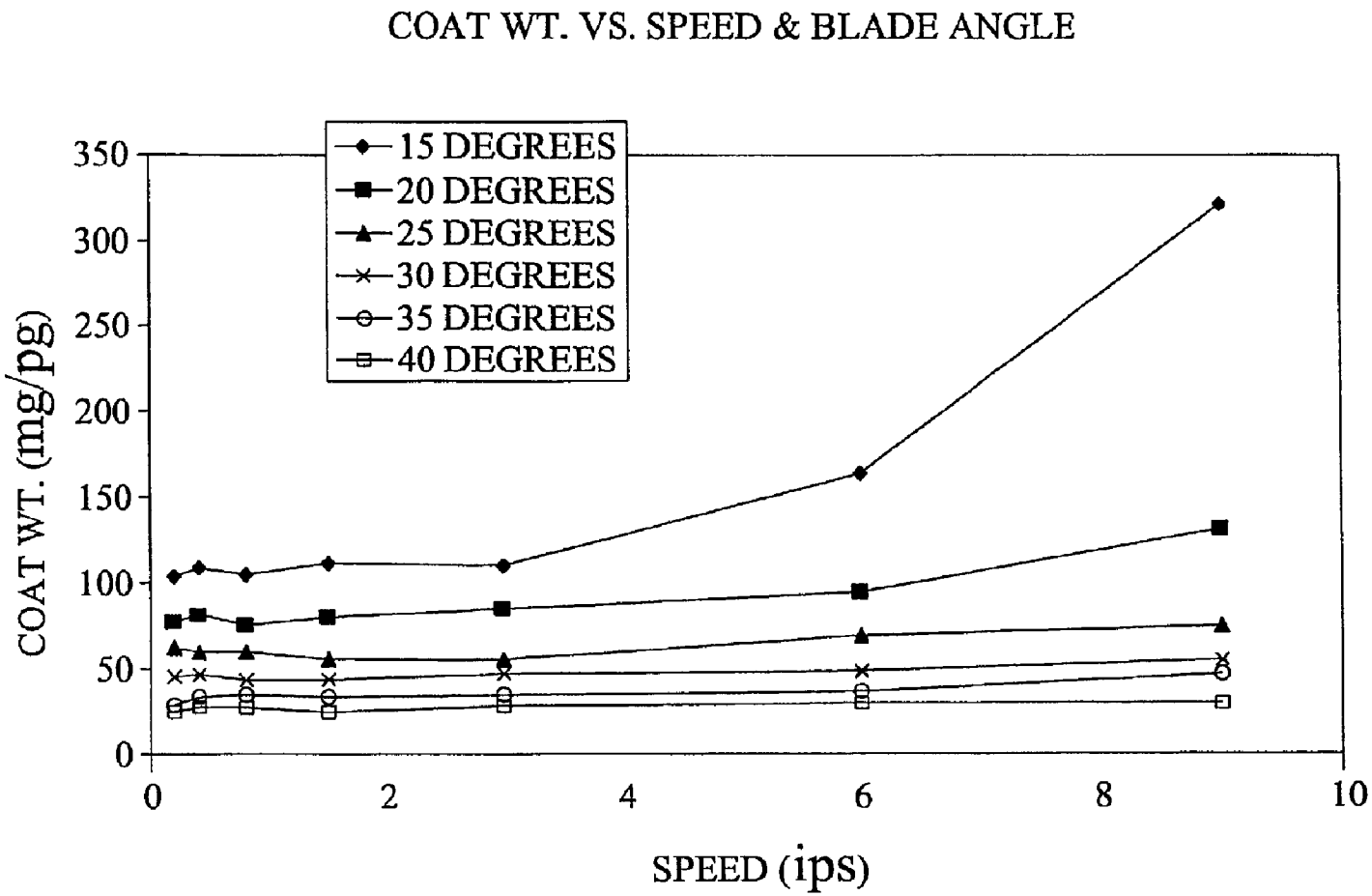
FIG. 4 is a chart of test results showing the relationship between coating weight and roller speed over a range of doctor blade contact angles.

Both the contact angle A and the contact force between the doctor blade 78 and the third roll 72 affect the sensitivity of the coating apparatus 10 to coating speed. Table 1 shows the results of experiments to investigate the relationship between coating weight and roller speed for different contact angles A. The data from Table 1 is graphically represented in FIG. 4. Those results showed that coat weight sensitivity to coating speed decreased as contact angle A was increased. With higher contact angles A, however, doctor blade wear is concentrated on the corner of the square edge of the doctor blade 78, and may result in more rapid deterioration of doctor blade performance.

TABLE 1

COAT WEIGHT VS. SPEED AND BLADE ANGLE

| SPEED (ips) | 15 degrees | 20 degrees | 25 degrees | 30 degrees | 35 degrees | 40 degrees |
|---|---|---|---|---|---|---|
| 0.2 | 103 | 77 | 62 | 45 | 29 | 26 |
| 0 4 | 108 | 81 | 60 | 46 | 33 | 27 |
| 0.8 | 105 | 75 | 59 | 43 | 35 | 27 |
| 1 5 | 111 | 79 | 55 | 43 | 33 | 24 |
| 3 | 108 | 83 | 54 | 45 | 33 | 26 |
| 6 | 160 | 91 | 65 | 45 | 33 | 26 |
| 9 | 315 | 126 | 69 | 49 | 41 | 24 |

The contact force between the doctor blade 78 and the third roll 72 should be high enough to overcome the hydrodynamic pressure occurring behind the doctor blade 78 tending to lift the distal edge 82 away from the third roll 72. Excessive contact force, however, may lead to increased doctor blade wear.

Figure 5:
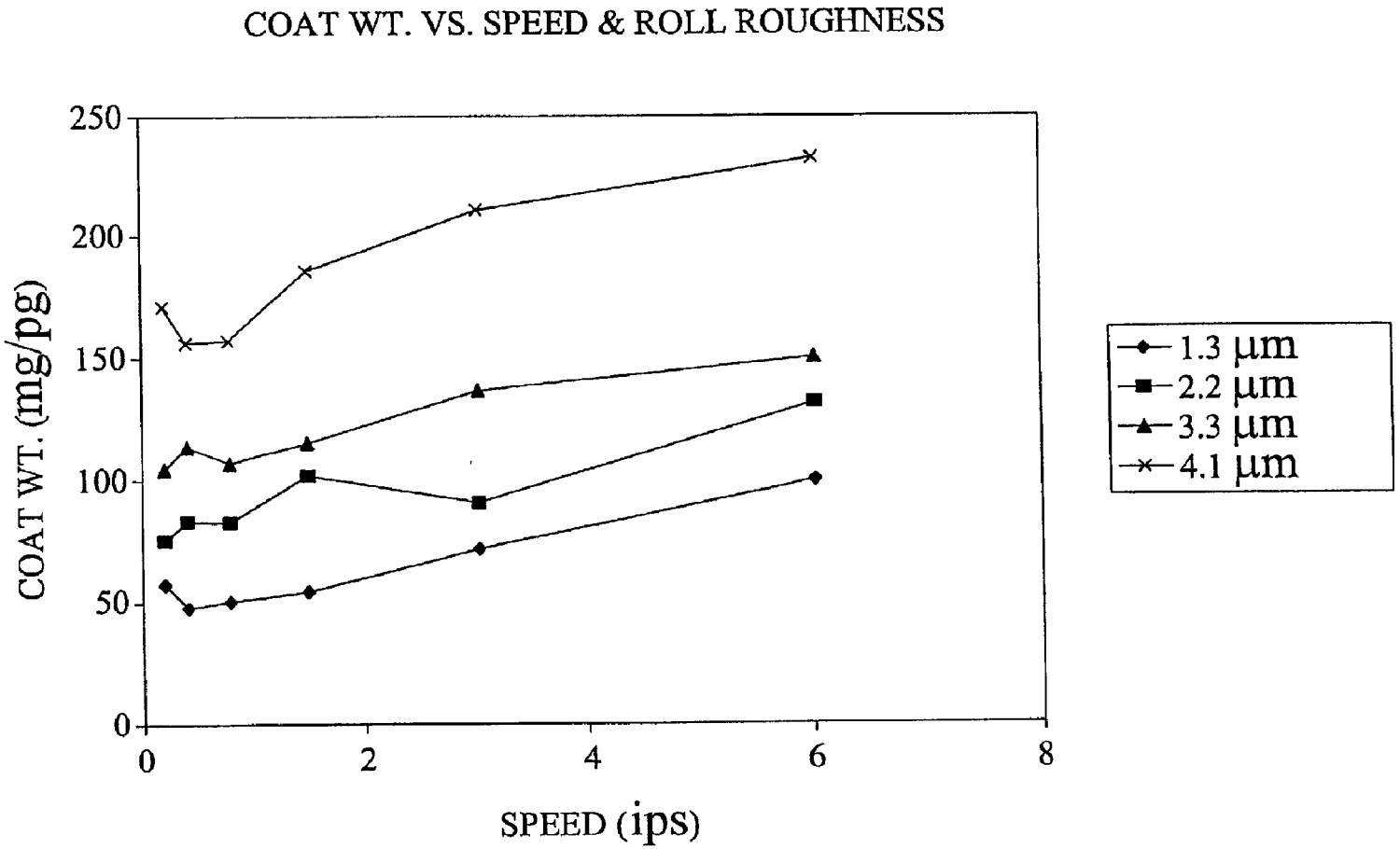
FIG. 5 is a chart of test results showing the relationship between coating weight and roller speed over a range of roller surface roughnesses.

Table 2 sets forth data showing the relationship between coating weight and coating speed for rolls of differing surface roughness. The data from Table 2 is graphically represented in FIG. 5. As expected, for a given roller speed, coat weight increased as roller roughness was increased.

TABLE 2

COAT WEIGHT VS. SPEED AND ROLL ROUGHNESS

| SPEED (ips) | 1 3 μm | 2 2 μm | 3.3 μm | 4 1 μm |
|---|---|---|---|---|
| 0 2 | 57 | 76 | 105 | 171 |
| 0.4 | 48 | 83 | 114 | 156 |
| 0.8 | 50 | 83 | 107 | 157 |
| 1 5 | 54 | 102 | 115 | 185 |
| 3 | 71 | 90 | 136 | 210 |
| 6 | 98 | 130 | 148 | 230 |

Combining the results of these investigations, it has been determined that the workable range of doctor blade 78 contact angles A with the third roll 72 is between about 15 and about 40 degrees at the distal end of the doctor blade 78. A workable range of contact forces is between about 0.1 and about 0.8 N/cm. Additionally, contact angles A between about 20 and about 30 degrees have also been found to be satisfactory, as have contact forces between about 0.4 and about 0.5 N/cm.

In one embodiment, the third roll 72 is manufactured from a metallic material, such as aluminum, and has a controlled and uniform texture on its outer cylindrical surface. Other materials may be selected to form the third roll 82. Roughness of the third roll 72 is generally between about 2.0 and about 3.7 micrometers $R_a$. In one embodiment, third roll 72 roughness is chosen between about 2.4 and about 3.0 micrometers $R_a$.

Referring to FIGS. 1 and 2, the coating liquid 12 and the second roll 58 according to the invention are now described in detail. As the third roll 72 rotates, its non-smooth outer surface carries liquid coating material 12 under the doctor blade 78 in an amount determined primarily by the size of the depressions or valleys formed in the outer surface of the roll. The second roll 58 contacts the third roll 72 at the second nip 76, and contact between the second roll 58 and third roll 72 is maintained throughout operation of the coating apparatus 10.

In one embodiment, the second roll 58 and third roll 72 have equal diameters, such that there is no slippage between the surfaces of those rolls when they are turned at the same angular velocity. In such an embodiment, the instantaneous linear velocity of a point on the outer surface of the second roll 58 is substantially equal to the instantaneous linear velocity of a point on the outer surface of the third roll 72 at any given time, and non-sliding contact is maintained between second and third rolls 58, 72 throughout operation of the coating apparatus 10. In another embodiment, the second roll 58 may be slightly smaller in diameter than the third roll 72, inducing a slight (~1%) overdrive condition. Under this design approach, the relative velocity of the two rolls 58, 72 is always in the same direction over the range of manufacturing tolerances. In still other embodiments, the rolls 58, 72 may be provided with greater mismatches in diameter, inducing more substantial overdrive conditions and slippage between the rolls 58, 72.

As the rolls rotate, the coating liquid 12 on the third roll is transferred to the second roll 58 by contact at the second nip 76. Once the coating liquid 12 is transferred to the second roll 58, the coating liquid is transferred from the second roll 58 to the substrate 20 passing through the first nip 62 as described in detail above. Optionally, a cleaning blade 94 may be provided in contact with the second roll 58. As shown in FIG. 1, the cleaning blade 94 may be constructed from the same materials and in the same configuration, but contacts the second roll 58 at a location between the first nip 62 and the second nip 76, after the second roll 58 contacts the printing substrate 20. The cleaning blade 94 may be provided to remove any residual coating liquid or debris remaining on the second roll 58 after the substrate 20 moves through the first nip 62.

According to one embodiment of the invention, the coating liquid 12 and the material that makes up the second roll 58 are selected such that the surface energy of the second roll 58 is greater than the surface energy of the coating liquid 12. If such a relationship is maintained, the coating liquid 12 tends to readily wet the second roll 58 and uniformly disperse across the outer surface, promoting consistent liquid application across the printing substrate 20 Transfer efficiency of the coating liquid 12 is also increased if the surface energies of the second roll 58 and the coating liquid 12 are in relatively close proximity to each other, while maintaining the quantitative relationship described above. If the surface energy of the second roll 58 is far greater than the surface energy of the coating liquid 12, the coating liquid 12 will tend to adhere to the outer surface of the second roll 58 and will resist transfer to the printing substrate 20, decreasing transfer efficiency.

In one embodiment, the coating liquid 12 is one which is designed to speed penetration of water into the printing substrate 20 and fix and flocculate the ink colorant on the surface of the substrate 20, thereby improving dry time, optical density and image permanence. Example coating materials are set forth in U.S. Pat. No. 6,183,079 and the references cited therein, and in U.S. patent applications Ser. No. 09/096,128, and Ser. No. 09/484,700, assigned to Lexmark International, Inc., which are incorporated herein by reference The coating apparatus 10 is capable of coating printing substrates 20 in a uniform manner up to a coat weight of up to about 150 milligrams per 8.5 inch by 11 inch printing substrate 20. Acceptable results have been observed at a coat weight of about 40–60 milligrams per printing substrate 20.

A suitable surface energy of the coating liquid 12 according to the invention has been experimentally determined to be in the range of about 30 to about 35 dyne/cm, when a second roll 58 having a surface energy in the range of about 35 to about 40 dyne/cm is utilized.

In another embodiment, the material from which at least one of the second roll 58 or the third roll 72 is formed is a compliant material to ensure contact along the entire second nip 76 In one embodiment, the second roll 58 is constructed of a compliant material and the first and third rolls 54, 72 are constructed of metals having a relatively high hardness. In this embodiment, the hardness of the second roll 58 is sufficiently low that the outer surface is capable of conforming to a substantial number of valleys in the front surface 22 of the substrate 20 such that coating material is transferred to those substrate valleys.

Alternatively, the materials from which the first and third rolls 54, 72 are formed may be compliant, while the second roll 58 is constructed from a metal or other relatively hard material In yet other embodiments, each of the rolls may be constructed of compliant materials In one embodiment, the second roll 58 may be manufactured from polyurethane. The second roll may be formed by any suitable means, including machining or casting. In one embodiment, the base polyurethane is a liquid castable polyether based urethane prepolymer, such as a product sold by Uniroyal Chemical under the designation "Adiprene L100" The prepolymer may be cured with a polyether type polyol, a polyester type polyol or an amine based curative. As non-limitative examples, a trifunctional curative such as a product sold by Seppic Corp. under the designation "Seppic TP30" may be used, or a blend of polyol curatives, such as Seppic TP30 and a product sold by Olin Corp. under the designation "Poly G 55-28." The ratio of blended polyols can be varied to reduce the hardness of the resulting urethane Plasticizers may also be added to reduce hardness. An 0amine, such as a product sold by Albemarle Corp under the designation "Ethacure 300" may be used to cure the polyurethane prepolymer instead of polyols. One skilled in the art will recognize that other alternatives for curing the polyurethane prepolymer also exist and may be utilized.

Other polyether urethanes, such as Adiprene L100, L315 or L167, also sold by Uniroyal, can also be used. These urethanes have a higher content of isocyanate functional groups ("NCO") compared to the Adiprene L42, and will give a harder final rubber.

Other compounds for the second roll 58, including but not limited to silicone, epichlorohydrin, ethylene, propylene and nitrile, may be utilized as long as they are wear resistant, somewhat compliant, manufacturable, compatible with the coating liquid, have low compression set, and the proper surface energy and surface roughness.

A silicone material may be added to lower the surface energy of the urethane. Silicone oils, such as a product sold by Dow Chemical Corp., under the designation "DC200," may be utilized. In other embodiments, silicone polyols, which have hydroxyl functionality, may be utilized. The hydroxyl groups on the silicone polyol react with the NCO groups in the polyurethane prepolymer and are cured into the polymer network, which provides resistance against deterioration of surface energy properties of the second roll 58 over time Silicone polyols containing a silicone main chain with a high molecular weight and hydroxyl termination, which are commercially available from Gelest, Inc, can be used These cure into the polymer and reduce surface energy Another example of a silicone polyol is a product sold by Chisso Corp., under the designation "FMDA11," having a low molecular weight hydrocarbon main chain with hydroxyl termination and a high molecular weight pendant silicone segment. Exemplary amounts of FMDA11 may vary from about 0.5% to about 20% by weight. One skilled in the art will recognize that other silicone polyols manufactured by the above-referenced suppliers or other suppliers may be utilized according to the invention.

The urethane formulation may also include a catalyst to increase the rate of reaction. Typical catalysts may include products sold by Air Products, Inc. under the designations "Dabco T12 or 33LV" at the levels recommended by the manufacturer. Triisopropanolamine, such as a products sold by Dow Chemical under the designations "TIPA 99" can also be added to aid in the curing reaction Table 3 sets forth an exemplary formulation of the second roll 58, in which the raw materials are heated to 80° C. and degassed in preparation for mixing. The polyol or curative amount used is adjusted based on the NCO content of the prepolymer and the OH values of the curatives to give a 95% stoichiometry, which calculations are known to those skilled in the art The materials are carefully mixed and cast around a metal core in a mold The material is cured for about 30–60 minutes at 120° C., then demolded and post-cured for about 16 hours at 100° C., then ground to the desired dimensions.

TABLE 3

EXEMPLARY SECOND ROLL FORMULATION

| Material | Weight (%) |
|---|---|
| Adiprene L100 | 88 3% |
| Perstorp TP30 | 5 3% |
| TIPA | 1.3% |
| FMDA11 | 5 0% |
| DabcoT12 | 0.02% |

To adjust the surface energy of the material that makes up the second roll 58 into the range of 35 to 40 dyne/cm, applicants have determined that the addition of about 2 to about 7 parts per hundred rubber ("PHR") of a silicone polyol compound to the second roll 58 material formulation produces acceptable results.

As described in greater detail below, the outer surface of the second roll 58 is substantially smooth in one embodiment. In another embodiment, the roughness of the outer surface of the second roll 58 is minimized. It has been determined that decreasing the roughness of the second roll 58 improves transfer efficiency of the coating apparatus 10 by increasing the area of contact with the uneven surface of the printing substrate 20. The lower bound of the second roll 58 roughness is currently determined only by manufacturing, cost and materials considerations There is no known functional lower bound. For the second roll 58 formed from the material described above, the current lower bound of surface roughness is about 0 2 micrometers $R_a$., which is primarily a function of manufacturing constraints. Acceptable results have been achieved by utilizing a second roll 58 having a surface roughness between about 0.2 and about 0.5 micrometers $R_a$, though a surface roughness of less than about 0 2 micrometers $R_a$ is also acceptable In the embodiment shown in FIG. 3, the coating apparatus includes only two rolls which form a first nip 62 through which the substrate 20 passes prior to ink jet printing. The second roll 58 is partially immersed in coating liquid 12, a portion of which is picked up by the second roll 58 and delivered to the doctor blade 78 The coating liquid 12 that passes the doctor blade 78 is transferred to the print medium 20 at the nip 62 formed between the second roll 58 and the first roll 54 The second roll 58 meters coating liquid 12 and transfers the liquid to the print medium 20. In this embodiment, a second roll 58 having a surface roughness of between about 1.0 and about 3.0 micrometers $R_a$ has been determined to carry sufficient coating liquid 12 past the doctor blade 78.

Figure 6:
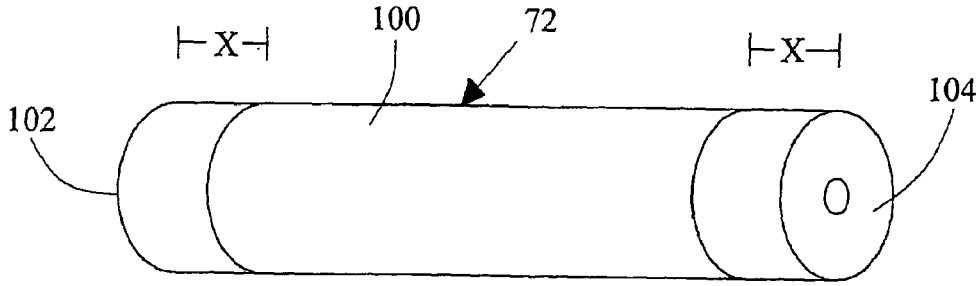
FIG. 6 is a perspective view of a third roll having a coating along a portion of the surface thereof according to one embodiment of the present invention.
Figure 7:
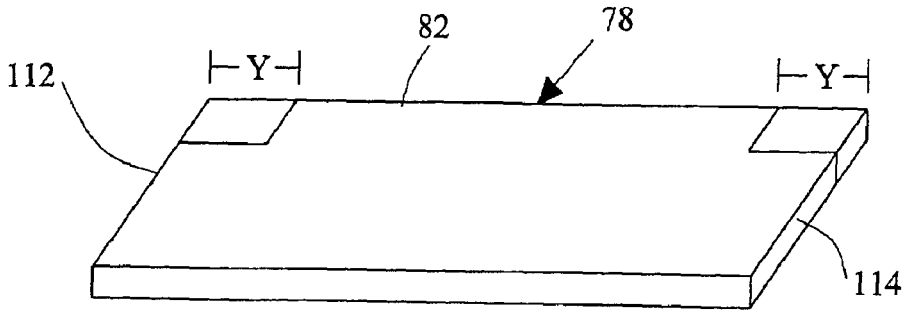
FIG. 7 is a perspective view of a doctor blade having a coating along a portion of the distal edge thereof according to one embodiment of the present invention.

Referring now to FIGS. 6 and 7, several additional embodiments of the invention are described in detail In embodiments of the coating apparatus having three rolls, such as those embodiments illustrated in FIGS. 1 and 2, a metering device may be provided that reduces or eliminates flow of coating liquid under or around the doctor blade 78 by capillary wicking According to the invention, the properties of the distal edge 82 of the doctor blade 78 may be controlled such that the surface energy of at least a portion of the distal edge 78 is less than the surface energy of the coating liquid. By providing the at least a portion of the distal edge 82 with a surface energy that is less than the surface energy of the coating liquid, capillary wicking under and around the doctor blade 78 is discouraged.

The surface energy of the coating liquid according to the invention has been experimentally determined to be in the range of about 30 to about 35 dyne/cm. In a coating apparatus utilizing such a coating liquid, at least a portion of the distal edge 82 of the doctor blade 78 may be provided with a surface energy less than the surface energy of the coating liquid, in the range of about 25 to about 30 dyne/cm As shown in FIG. 6, the third roll 72 is substantially cylindrical and includes a surface 100, a first end 102, an opposite second end 104 and a longitudinal length between the respective ends 102, 104. As shown in FIG. 7, the doctor blade 78 also includes a first end 112, an opposite second end 114 and a longitudinal length between the respective ends 112, 114. In some embodiments, substantially the entire longitudinal length of the distal edge 82 of the doctor blade 78 exhibits the above-described surface energy characteristics.

It has been observed that the coating liquid most abundantly available for flow to the downstream side of the doctor blade 78 is near the respective ends of the doctor blade 112, 114 and the third roller 102, 104. Thus, in embodiments such as the embodiment illustrated in FIG. 7, only portions Y of the distal edge 82 adjacent the first and second ends 112, 114 of the doctor blade 78 exhibit such surface energy characteristics. Satisfactory prevention of capillary wicking around the ends of the doctor blade has been achieved by providing the above-described surface energy characteristics along the distal edge within about 1 centimeter of each respective end of the doctor blade.

In other embodiments, acceptable results have been obtained by providing larger or smaller portions Y of the distal edge 82 with the above-described surface energy characteristics. For example, portions Y measuring about 0.7, 1.5, 2.0, 2.5 and 3.0 centimeters, as well as portions Y measuring distances between these stated values or extending across all or substantially all of the width of the distal edge 82, have been found to produce satisfactory results.

It is possible to control the surface energy of desired portions of the distal edge 82 of the doctor blade 78 by applying a coating to the doctor blade 78. A variety of coatings have been found to be sufficient, including but not limited to coatings of silicone wax, vapor phase deposited fluorocarbon (about 100 Å to about 10,000 Å thickness), and either dipped or spray-coated Teflon (PFTE). Coatings of silicone wax are further described in U.S. Pat. No. 5,952,442, assigned to Lexmark International, Inc., which disclosure is expressly incorporated herein by reference.

In another embodiment, as illustrated in FIG. 6, similar results may be obtained by controlling the properties of the third roll 72 such that the surface energy of at least a portion of the surface 100 of the third roll 72 is less than the surface energy of the coating liquid. As with the previously described embodiment, the entire length of the third roll 72, or only a portion X thereof measuring about 1 cm from the respective ends 102, 104 of the third roll 72, may be provided with a surface energy less than the surface energy of the coating liquid, in the range of about 25 to about 30 dyne/cm Additionally, portions X having the lengths disclosed above in connection with the portions Y of the distal edge 82 of the doctor blade 78 may be utilized according to the invention. The same coatings set forth above in connection with the doctor blade 78 may be provided to the surface 100 of the third roll 72 to control the surface energy thereof When coatings are provided to only a portion of the distal edge 82 of the doctor blade 78 or the surface 100 of the third roll 72, care must be taken to prevent creating a "step" or gap at transition points between coated and uncoated surfaces. Steps or gaps may allow excess coating liquid to pass the doctor blade 78, creating an uneven coat of liquid along the third roll 72. Such steps or gaps may be avoided by any of several means, such as by providing a sufficiently thin coating layer or by gradually reducing coating weight at the edges of such coated portions to prevent creation of such a gap.

In yet another embodiment, coating treatments as set forth above may be provided to both the third roll 72 and the doctor blade 78. Improvements (expressed in percentage improvement over a system without coating treatments on either the third roll 72 or the doctor blade 78) for combinations of treatments on the third roll 72 and the doctor blade 78 are summarized in Table 4

TABLE 4

SURFACE TREATMENTS FOR DOCTOR BLADE AND THIRD ROLL

| | | Third Roll Treatment | | | |
|---|---|---|---|---|---|
| | | Teflon | Silicone Wax | Fluorocarbon | No Treatment |
| Doctor | Fluorocarbon | 50 | 50 | 50 | 30 |
| Blade | Silicone Wax | 95 | 95 | 95 | 75 |
| Treatment | No Treatment | 30 | 30 | 30 | 0 |

Although the present invention has been described with reference to specific details of certain embodiments thereof, it is not intended that such details should be regarded as limitations upon the scope of the invention except as and to the extent that they are included in the accompanying claims.

What is claimed is:

1. A metering device for providing a layer of coating liquid to a coating apparatus wherein the coating apparatus has a rotatable first roll and a rotatable second roll defining with the first roll a first nip through which a printing substrate passes, comprising:

a. a rotatable third roll having a surface energy;

b. a supply of coating liquid having a surface energy, the supply of coating liquid being in contact with the third roll; and c. a doctor blade for metering a layer of coating liquid onto the third roll, the doctor blade having a distal edge with a surface energy that contacts the third roll, wherein the surface energy of a portion of the distal edge adjacent a first end of the doctor blade and a portion of the distal edge adjacent a second end of the doctor blade have a surface energy that is less than the surface energy of the coating liquid.

2. The metering device of claim 1, wherein the surface energy of the coating liquid is between about 30 and about 35 dyne/cm.

3. The metering device of claim 1, wherein the surface energy of at least a portion of the distal edge is between about 25 and about 30 dyne/cm.

4. The metering device of claim 1, wherein the third roll is substantially cylindrical, comprises a surface, a first end, an opposite second end and a longitudinal length between the first and second ends, and defines with the second roll a second nip.

5. The metering device of claim 4, wherein the doctor blade further comprises a first end and an opposite second end, and wherein the distal edge of the doctor blade extends between the first and second ends of the doctor blade and has a longitudinal length.

6. The metering device of claim 5, wherein the surface energy of substantially the entire length of the distal edge of the doctor blade is less than the surface energy of the coating liquid.

7. The metering device of claim 1, wherein the portions of the distal edge extend at least about 1 cm from the first end of the doctor blade along the longitudinal length thereof and at least about 1 cm from the second end of the doctor blade along the longitudinal length thereof, respectively.

8. The metering device of claim 1, wherein the at least a portion of the distal edge comprises a coating of silicone wax having a surface energy that is less than the surface energy of the coating liquid.

9. The metering device of claim 1, wherein the at least a portion of the distal edge comprises a fluorocarbon coating having a surface energy that is less that the surface energy of the coating liquid.

10. The metering device of claim 1, wherein the at least a portion of the distal edge comprises a coating of PTFE (polytetrafluoroethylene) having a surface energy that is less than the surface energy of the coating liquid.

11. A metering device for providing a layer of coating liquid to a coating apparatus wherein the coating apparatus has a rotatable first roll and a rotatable second roll defining with the first roll a first nip through which a printing substrate passes, comprising:

a. a rotatable third roll having a surface energy;

b. a supply of coating liquid having a surface energy, the supply of coating liquid being in contact with the third roll; and c. a doctor blade for metering a layer of coating liquid onto the third roll, the doctor blade having a distal edge with a surface energy that contacts the third roll, wherein the surface energy of a portion of the surface of the third roll adjacent a first end thereof and a portion of the third roll adjacent a second end thereof have a surface energy that is less than the surface energy of the coating liquid.

12. The metering device of claim 11, wherein the surface energy of the coating liquid is between about 30 and about 35 dyne/cm.

13. The metering device of claim 11, wherein the surface energy of the at least a portion of the third roll is between about 25 and about 30 dyne/cm.

14. The metering device of claim 11, wherein the third roll is substantially cylindrical, comprises a surface, a first end, an opposite second end and a longitudinal length between the first and second ends, and defines with the second roll a second nip.

15. The metering device of claim 14, wherein the doctor blade further comprises a first end and an opposite second end, and wherein the distal edge of the doctor blade extends between the first and second ends of the doctor blade and has a longitudinal length.

16. The metering device of claim 15, wherein the surface energy of substantially the entire surface of the third roll is less than the surface energy of the coating liquid.

17. The metering device of claim 11, wherein the portions of the surface of the third roll extend at least about 1 cm from the first end of the third roll along the longitudinal length thereof and at least about 1 cm from the second end of the third roll along the longitudinal length thereof, respectively.

18. The metering device of claim 11, wherein the at least a portion of the distal edge comprises a coating of silicone wax having a surface energy that is less than the surface energy of the coating liquid.

19. The metering device of claim 11, wherein the at least a portion of the distal edge comprises a fluorocarbon coating having a surface energy that is less than the surface energy of the coating liquid.

20. The metering device of claim 11, wherein the at least a portion of the distal edge comprises a coating of PTFE (polytetrafluoroethylene) having a surface energy that is less than the surface energy of the coating liquid.

* * * * *